US005215007A

United States Patent [19]

Sebright et al.

[11] Patent Number: 5,215,007

[45] Date of Patent: Jun. 1, 1993

[54] APPARATUS FOR EXTRACTING LIQUID FROM A COMPOSITE MASS

[75] Inventors: Brent H. Sebright; Stuart L. Sebright, both of Hopkins; Boyd C. Slusser, Zeeland, all of Mich.

[73] Assignee: Sebright Products, Inc., Hopkins, Mich.

[21] Appl. No.: 760,758

[22] Filed: Sep. 16, 1991

[51] Int. Cl.[5] ..... B30B 9/06

[52] U.S. Cl. ..... 100/45; 100/116; 100/127; 100/192

[58] Field of Search ..... 100/104, 110, 116, 126, 100/127, 128, 129, 179, 191, 192, 45

[56] References Cited

U.S. PATENT DOCUMENTS

| | | | |
|---|---|---|---|
| 502,558 | 8/1893 | Gest et al. | 100/116 X |
| 1,602,626 | 10/1926 | Power | 100/116 X |
| 1,782,273 | 11/1930 | Riemann | 100/116 X |
| 2,587,997 | 3/1952 | Guettler | 100/127 X |
| 2,615,387 | 10/1952 | Messing | 100/129 X |
| 3,785,280 | 1/1974 | LeJeune | 100/127 X |
| 3,789,752 | 2/1974 | Wirz | 100/127 X |
| 3,913,474 | 10/1975 | Lewis | 100/45 |
| 4,467,715 | 8/1984 | Bunger | 100/116 X |
| 4,603,909 | 8/1986 | LeJeune | 100/127 X |

FOREIGN PATENT DOCUMENTS

| | | | |
|---|---|---|---|
| 713880 | 11/1931 | France | 100/116 |
| 2582985 | 12/1986 | France | 100/116 |
| 998428 | 7/1965 | United Kingdom | 100/110 |
| 2129328 | 5/1984 | United Kingdom | 100/110 |

OTHER PUBLICATIONS

Brochure entitled "Marathon Dewatering Systems," published by Marathon Equipment Company in 1990.

*Primary Examiner*—Stephen F. Gerrity

*Attorney, Agent, or Firm*—Varnum, Riddering, Schmidt & Howlett

[57] ABSTRACT

An apparatus for removing liquid from a composite mixture of liquid and solids comprising a hopper 16 mounted atop a compactor ram assembly 10, having a snout section 12 and an extruder section 14 mounted in a generally axial direction to the compactor ram assembly 10. Wet waste material is loaded into the hopper 16 and falls onto a loading floor 158. A hydraulically operated ram 208 compresses the wet material into the snout and extruder sections 12, 14. Under pressure from the ram 208, liquid in the waste material escapes from numerous drainage holes 25 in the loading floor, the snout section top, bottom and sides 24, 22, 20, the extruder section top, bottom and sides 30, 28, 26 and holes 212 in the ram face 210. A platen 80, pivotally mounted to the extruder top plate 30 near the exit of the device and biased with a constant pressure, controls the back pressure in the extruder and snout sections 14 12. A first embodiment has a converging extruder section 14, having a narrower cross section at the exit of the section, which aids in compacting the material being dewatered. A second embodiment has a slightly diverging extruder section to prevent impaction of dewater material inside the device when operating with certain composite mixtures such as paper pulp.

25 Claims, 14 Drawing Sheets

APPARATUS FOR EXTRACTING LIQUID FROM A COMPOSITE MASS

BACKGROUND OF THE INVENTION

1. Field of the Invention

This invention relates to compression-operated liquid extraction devices. It is specifically directed to an improved design of the extraction section and draining means.

2. Description of Related Art

Batch process, compression-driven liquid extraction devices have been well known for many years. Existing devices compress wet waste in a compression chamber below a loading hopper. An hydraulic ram provides pressure to the wet waste. Drainage holes or grates in the sides of the compression chamber permit liquid to escape from the wet waste. Typically, the liquid is extracted directly under the loading hopper. A few designs provide a short extension of the compression chamber past the loading hopper to improve the liquid extraction efficiency. A door on the exit of the chamber is sometimes used to increase the back pressure and obtain a higher degree of compression.

The existing designs generally provide inadequate or incomplete moisture extraction for some important purposes. For example, the moisture content of paper pulp waste, after being processed through existing compression-driven extracting devices, typically exceeds 65% which is not acceptable for many landfills or incinerators. In addition, liquid in the remaining mass is largely unevenly distributed; there is more liquid remaining in the top and bottom of the mass than at the sides. With existing devices, liquid from inside the mass of wet waste must take a longer path to reach a drainage exit. To compensate, the grate design of existing devices provides additional area for drainage but allows a higher percentage of solids to escape with the liquid and also clog the grates. In addition, the grate design of existing devices is unsuitable for high-pressure service. Impaction of dewatered waste in the compression chamber further limits existing designs.

SUMMARY OF INVENTION

A novel design of an apparatus for extracting liquid from a composite mass of liquids and solids according to the invention comprises a housing and an extruder connected to the housing. The housing has a cavity which is open at one end of the housing. An axis is defined in the housing which extends through the cavity and the open end. The extruder is connected to the housing at the open end and has opposed top and bottom walls and opposed side walls. The top, bottom, and side walls thereby define a channel which is in communication with the cavity. The channel extends to an exit opening from the extruder, with the bottom wall being inclined upwardly at an angle from the axis. Each of the walls of the extruder has a matrix of apertures extending therethrough.

A first platen is mounted within the housing for movement from a retracted position adjacent the cavity and through the cavity and along the axis to an extended position near the open end of the housing. Preferably, the platen also has a matrix of apertures extending through it. An hydraulic cylinder is operably connected to the first platen to cause it to move to and from the extended position.

A second platen is mounted to one of the extruder walls near the exit opening for pivotable movement inwardly of the channel. The second platen is preferably configured to restrict the cross-sectional area of the channel. The second platen is biased to maintain it inwardly of the channel against a predetermined pressure. Thus, a composite mass introduced into the cavity of the housing is compressible within the cavity and the channel between the first and second platens. The pressure introduced to the mass by action of the first platen moving to an extended position causes liquid within the mass to be forced through the apertures. When the pressure in the mass exceeds a predetermined pressure, the mass is caused to move through the exit opening for subsequent disposal.

In one aspect of the invention, at least one of the extruder walls diverges away from its opposing wall so that the cross-sectional area of the channel near the housing is less than the cross-sectional area of the channel away from the housing. Preferably, the side walls diverge away from the axis, and the amount of divergence is approximately 1 inch in 10 feet.

In another aspect of the invention, at least one of the extruder walls converges toward its opposing wall so that the cross-sectional area of the channel near the housing is greater than the cross-sectional area of the channel away from the housing. Preferably, both top and bottom walls converge, and the side walls converge. In a typical application, the cross-sectional area of the channel at the connection to the housing is 1500 square inches, and the cross-sectional area of the channel at the connection of the second platen is 1025 square inches.

Preferably, the cavity is open through the top of the housing to facilitate introduction of a composite mass into the apparatus. A loading platform can be mounted within the housing at a lower portion of the cavity to support the composite mass, and preferably, the loading platform also has a matrix of apertures.

In a preferred embodiment, the predetermined pressure, above which the second platen will retract and the mass can be forced out of the extruder, is 1500 psi. Typically, the diameter of the apertures in the various matrices is in a range of $\frac{1}{8}$ to $\frac{3}{8}$ inches, and the spacing of the apertures is within a range of $1\frac{1}{2}$ to 4 inches.

BRIEF DESCRIPTION OF THE DRAWINGS

The invention will now be described with reference to the following drawings wherein.

DETAILED DESCRIPTION OF THE DRAWINGS

Figure 1:
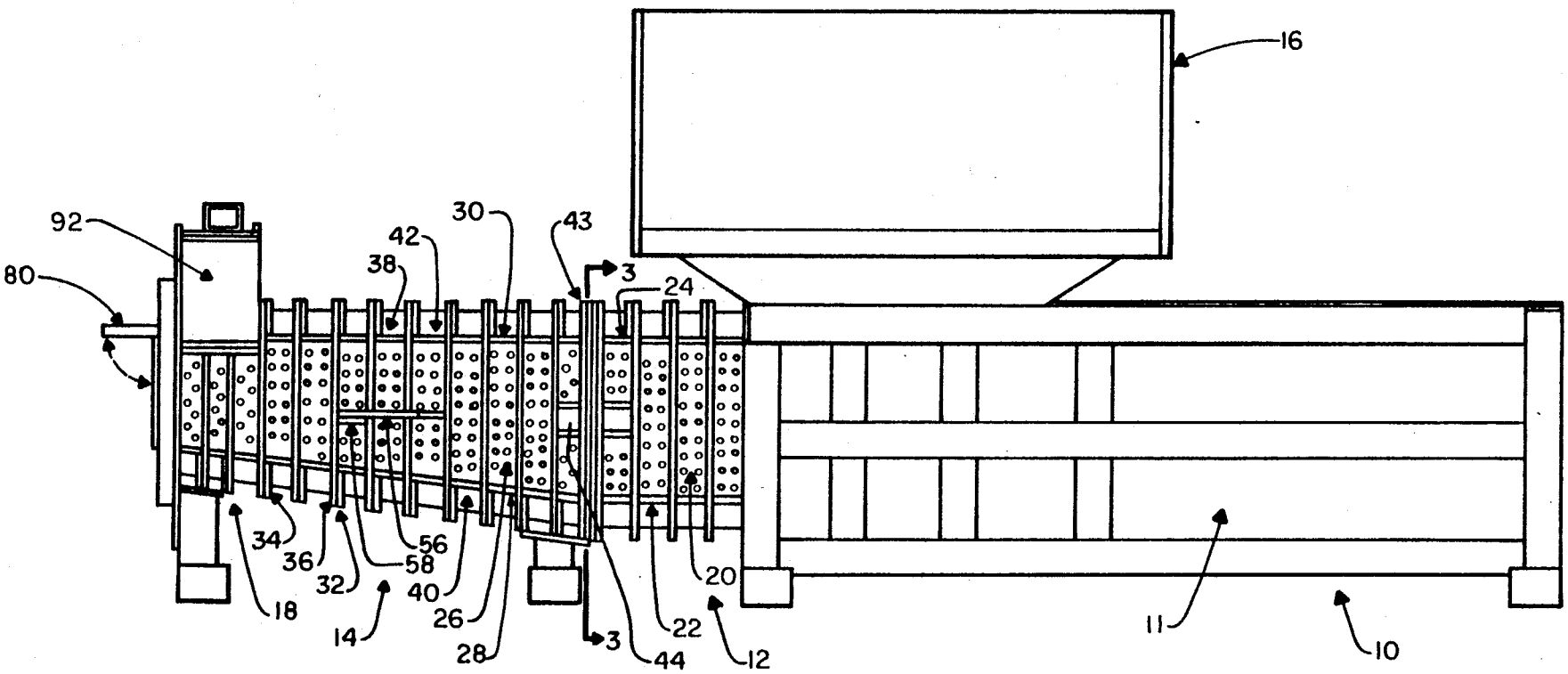
FIG. 1 is a left side elevation of a first embodiment of a dewatering device according to the invention.
Figure 2:
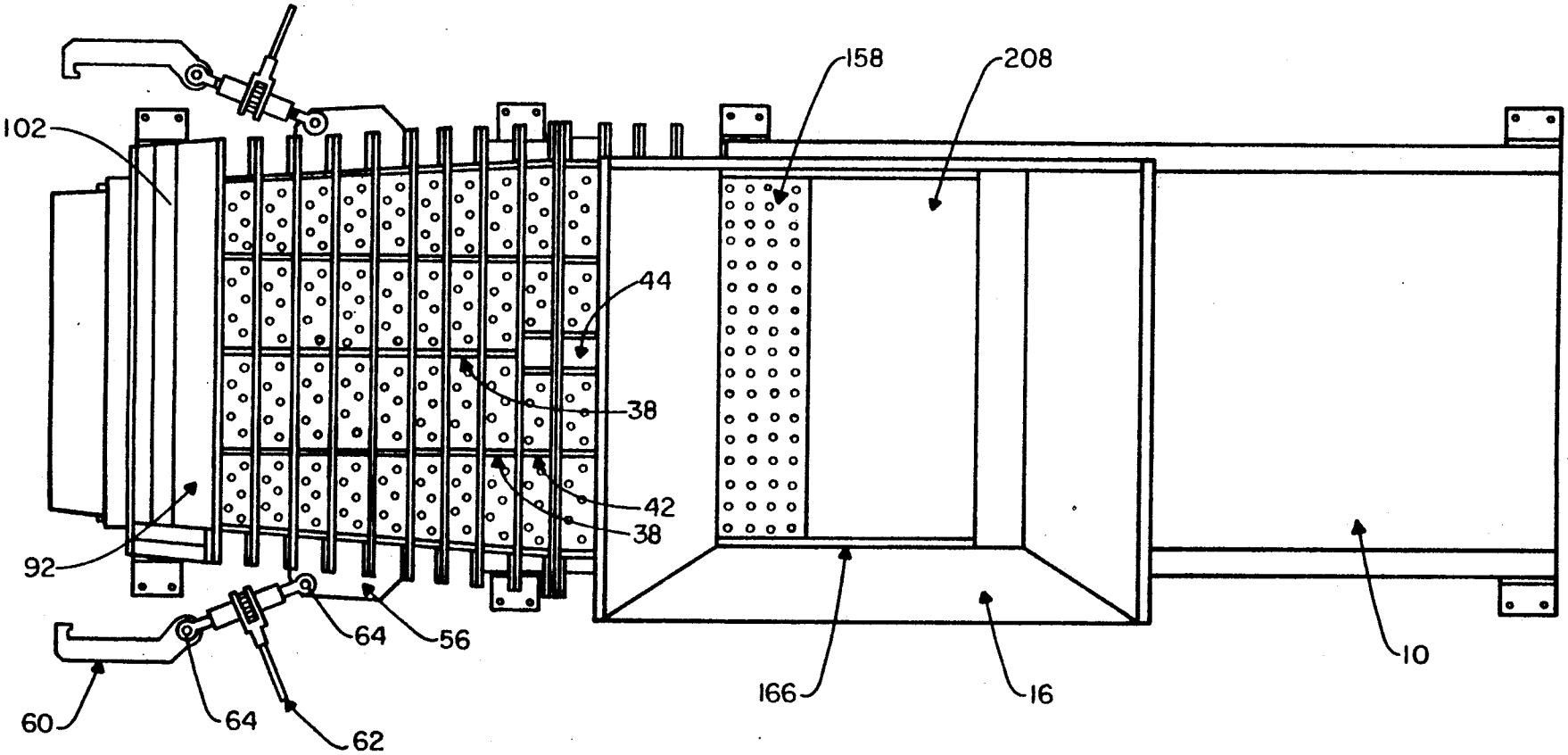
FIG. 2 is a plan view of the dewatering device of FIG.1.

Referring now to the drawings and to FIGS. 1 and 2 in particular, it can be seen that a first embodiment of the device comprises generally, a hopper 16 mounted atop a horizontal compactor ram assembly 10, having a snout section 12, an extruder section 14, and an extruder plenum assembly 18 mounted in a generally axial direction to the compactor ram assembly 10.

The dewater material is a composite mass of liquid and solids which the device compresses to remove much of the liquid, leaving a drier product more suitable for land fill. The liquid in dewater material is typically not just water but also may include oils, greases, solvents and other liquids. Typical liquid and solid mixtures which require dewatering include paper pulp, garbage, animal hair and follicle solvent from leather manufacture, animal by-products, dairy products, and other wet waste products The input dewater material is typically 5%-15% solids. The output dewater material from a device according to the invention can typically be 54% or higher solids, greatly exceeding the dewatering capacity of existing devices.

In operation, the hopper 16 feeds dewater material into a cavity in the device. A platen of a ram 208 operated by one or more hydraulic cylinders pushes the dewater material into the snout section 12 and then into the extruder section 14. Pressure supplied by the ram 208 drives liquid out of the dewater material through matrices of drainage holes 25 in the top side and bottom of the snout and extruder sections 12, 14 and through additional holes 212 in the ram face 210. Another platen 80, rotatably mounted near the exit of the extruder section 14 and biased with a constant pressure, restricts the passage of the dewater material out of the extruder and controls pressure inside the extruder.

The snout section 12 is a generally rectangular shaped horizontal duct comprised of two parallel rectangular snout side plates 20, a rectangular snout bottom plate 22, normal to the face of the snout side plates 20, and a parallel rectangular snout top plate 24, all of which are penetrated by a matrix of small drainage holes 25 which permit the liquid to escape during the dewatering process. The extruder section 14 is similarly constructed, having extruder side plates 26, an extruder bottom plate 28 and an extruder top plate 30 all of which are also penetrated by drainage holes 25.

In the first embodiment, the extruder section 14 has a converging shape, having a smaller opening at its exit than at its entrance. The extruder top plate 30 is oriented horizontally, but the extruder bottom plate 28 is oriented with an upward tilt, as shown in FIG. 1, with the edge connecting to the extruder plenum 18 higher than the edge connected to the snout section 12. The extruder side plates 26 are also oriented to provide a converging flow for the dewater material through the device, as shown in FIG. 2, with the edges of the extruder side plates 26 connected to the snout section 12 farther apart than the edges of the extruder side plates 26 connected to the extruder plenum 18. The converging design of the extruder section 14 helps to compact the dewater material as water is removed by the device. The angle of the extruder bottom plate 28 allows extracted liquid to flow by gravity away from the extruder plenum 18. Additionally, the angle of the extruder bottom plate 28 causes the compressed dewater material to exit the device at an upward angle and gravity causes the flow to buckle and more efficiently fill a waste container (not shown).

Both the snout section 12 and the extruder section 14 have a series of girdle ribs 32 encircling the circumference of the sections. Each girdle rib 32 comprises two long rectangular vertical brace pieces 36 mounted edgewise on opposite extruder side plates 26, and two rectangular horizontal brace pieces 34 mounted edgewise to the extruder top plate 30 and the extruder bottom plate 28 respectively. The ends of the horizontal and vertical brace pieces 34, 36 extend beyond the sides of the snout and extruder sections 12, 14 and are fastened together in a lap joint to complete the girdle ribs 32. Additional bracing in the snout and extruder sections is provided by three top lateral ribs 38 mounted edgewise and axially to the extruder top plate 30 and snout top plate 24, and three bottom lateral ribs 40 mounted edgewise and axially to the extruder bottom plate 28 and snout bottom plate 22. The top and bottom lateral ribs 38, 40 are formed from brace plates 42 inserted between the faces of the girdle ribs 32.

The extruder section 14 is provided with two container grab hooks 60 mounted at each side by means of a ratchet turnbuckle 62 and a grab hook mounting bracket 56 and grab hook mounting bracket brace 58 which are attached to the side of the snout section 12. Each ratchet turnbuckle 62 is rotatably mounted about a vertical axis by means of a rotating fastener 64 at one end to a grab hook mounting bracket 56 and grab hook mounting bracket brace 58, and at the opposite end to a container grab hook 62. The container grab hooks 60 are adapted to receive and hold in place a waste container to receive the dewater material at the end of the process.

Figure 13:
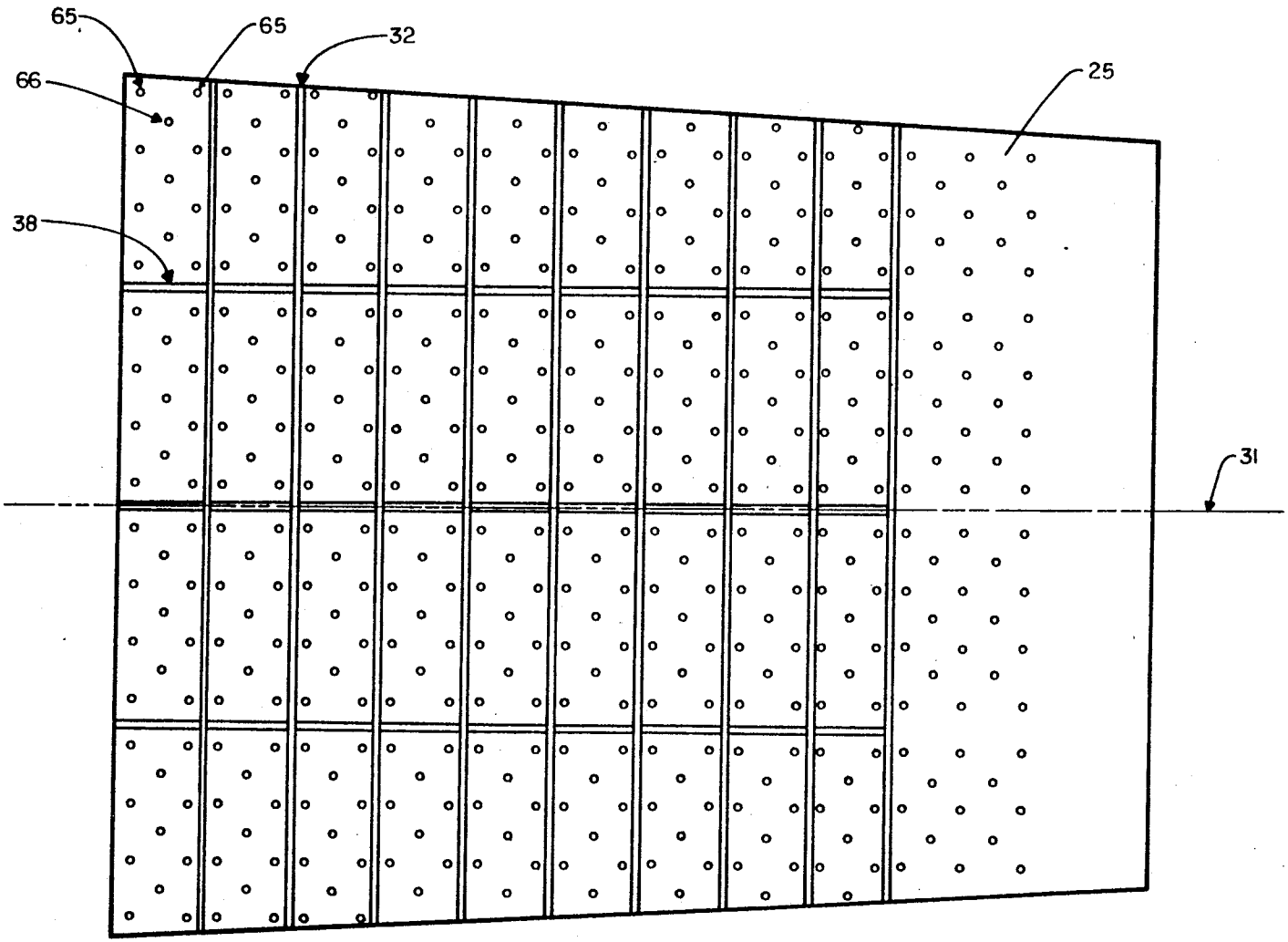
FIG. 13 is a detail view of the extruder top plate for the first embodiment showing the drainage hole arrangement.

FIG. 13 shows the drainage holes 25 in the top and bottom extruder plates 30, 28 arranged in rows parallel to the girdle ribs 32, with each row starting at a longitudinal centerline 31 of the extruder plate 30, 28 and extending out to the outside edge of the extruder plate 30, 28, having either an arrangement "A" 65 or an arrangement "B" 66. In both arrangements, the drainage holes 25 are preferably sized at ¼ inch in diameter, with an acceptable range of ⅛ to ⅜ inches an inch in diameter, and are spaced on 2-inch centers.

Arrangement "A" 65, orients the row so that the center of the first drainage hole 25 is 1⅝ inches from the center line 31 of the extruder plates 30, 28 and subsequent drainage holes are spaced on two inch centers in the row arrangement "A" 65 as it extends to the outside edge of the extruder plate 30, 28. Arrangement "B" 66 orients the row so that the center of the first drainage hole 25 is 3⅜ inches from the center line 31, with subsequent drainage holes 25 spaced on two inch centers in the row arrangement "B" 66 as it extends to the outside edge of the extruder plate 30, 28. The parallel rows of drainage holes 25 are arranged in the repeating sequence arrangement "A" 65, arrangement "B" 66, arrangement "A" 65, along the face of the top and bottom extruder plates 30, 28 with the rows spaced 2 inches apart.

Figure 12:
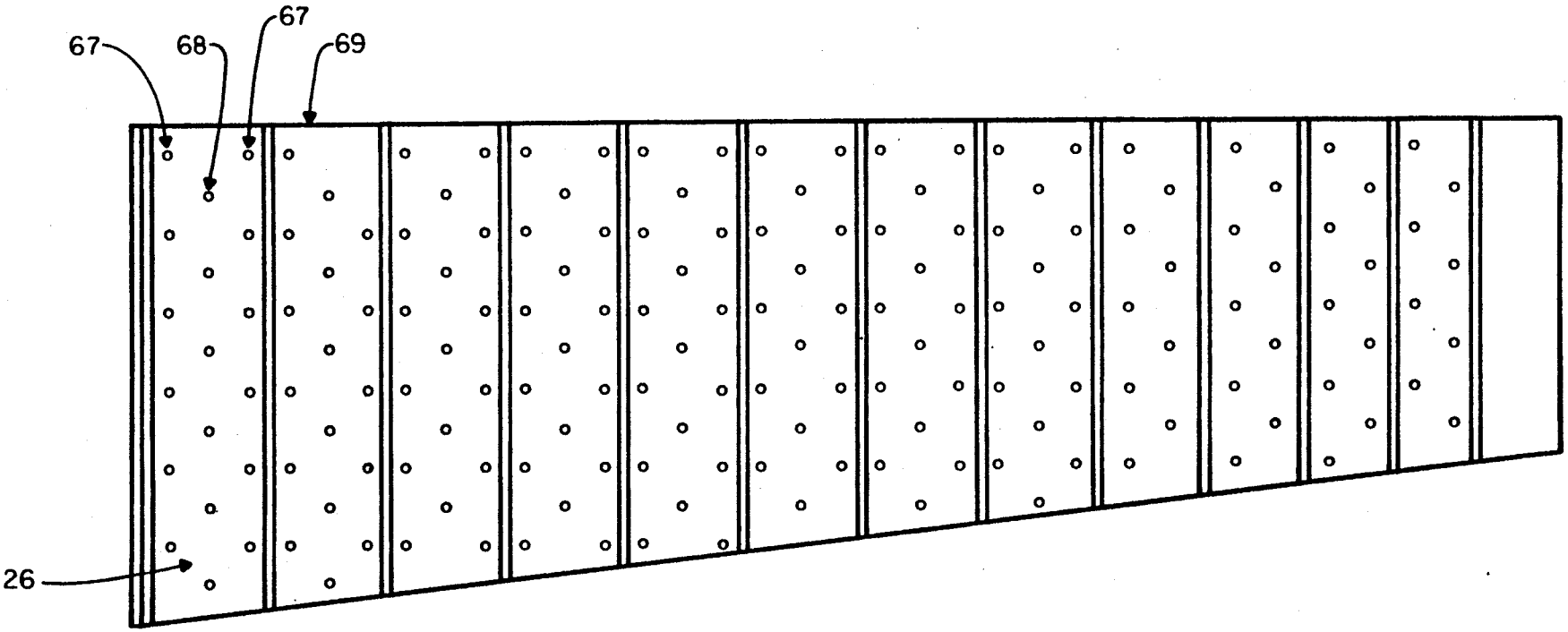
FIG. 12 is a detail view of the extruder side plates for the first embodiment showing the drainage hole arrangement.

FIG. 12 shows a similar arrangement of drainage holes 25 in rows parallel to the girdle ribs 32 on the extruder side plates 26 in two arrangements each having holes on two inch centers and each row spaced two inches apart. The center of the first drainage hole 25 in arrangement "C" 67 is 1½ inches from the top edge 69 of the extruder side plate 26 with subsequent holes in the row spaced two inches apart and extending to the opposite edge of the extruder side plate 26. Arrangement "D" is similar, but the center of its first hole is 3½ inches from the top edge 69. The parallel rows of drainage holes 25 are arranged in the repeating sequence arrangement "C" 67, arrangement "D" 68, arrangement "C" 67, along the face of the extruder side plates 26.

In all of the extruder plates 26, 28, 30 the drainage holes 25 are generally spaced two inches apart from each other within a row and each row is spaced two inches apart from the adjacent row. Alternating arrangements "A" and "B" 65, 66 and "C" and "D" 67, 68 offset one inch from each other. The drainage holes 25 are arranged similarly in the snout section 12.

The drainage holes 25 are preferably ¼ inch in diameter with a range of ⅛ to ⅜ inches depending upon the material being dewatered. Smaller drainage holes 25 decrease the area for liquid to exit the machine and thus the extraction efficiency, larger drainage holes 25 increase the amount of solids in the dewater mixture escaping through the drainage holes 25.

Figure 3:
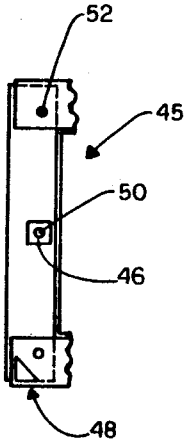
FIG. 3 is a view in cross section taken along the line 3—3 of FIG. 1 showing the extruder section mounting in detail.

Referring now to FIG. 3, the extruder section 14 is mounted to the snout section 12 by means of fasteners 54 penetrating fastener holes 52 located in an extruder section mounting plate 43 mounted at the end of the extruder section 14, and mating fastener holes 52 located in a snout section mounting plate 45 mounted at the end of the snout section 12. The extruder and snout section mounting plates 43, 45 are comprised of girdle ribs 32 adapted for mounting. Both the extruder section mounting plate 43 and the snout section mounting plate 45 have fastener holes 52 penetrating their faces at each corner and in the center of the horizontal brace plates 34 and the vertical brace plates 36 forming the girdle rib 32. Plate spacers 46, of the same thickness as the horizontal brace plates 34, are mounted on each vertical brace plate 36 of the extruder section mounting plate 43 and the snout section mounting plate 45, and are also penetrated by the fastener holes 52. The snout section mounting plate 45 has a triangle-shaped gusset 48 mounted in each of its lower corners. The extruder section mounting plate 43 has gusset notches 50 in the lower corners shaped to receive the gusset plates 48. A fastener channel 44 is formed about each of the fasteners in the middle of the horizontal braces 34 and vertical braces 36 by means of brace plates 42 mounted adjacent to the fastener hole 52 and perpendicular to the extruder section mounting plate 43 and the nearest adjacent girdle rib 32 and between the snout section mounting plate 45 and the nearest adjacent girdle rib 32.

Figure 4:
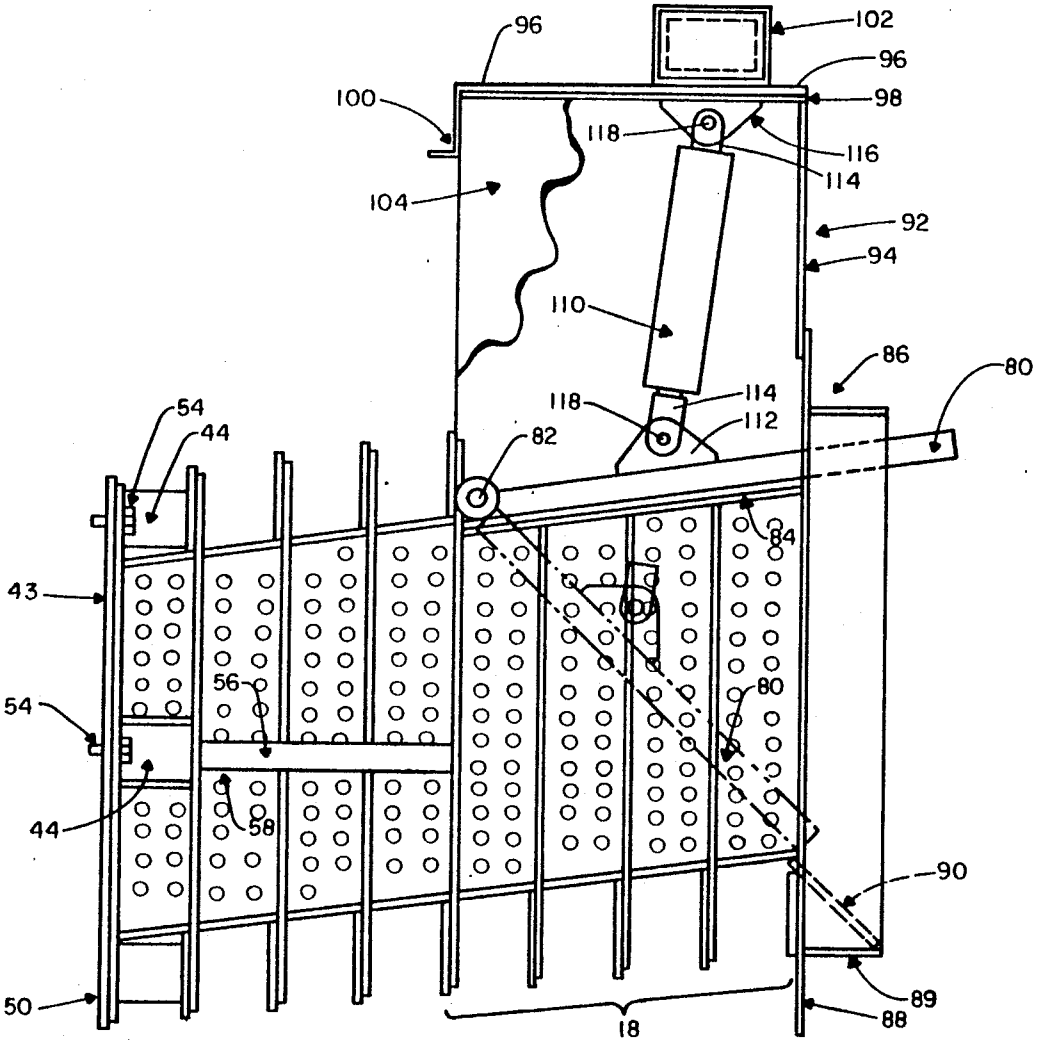
FIG. 4 is a partial side elevation of the dewatering device of FIG. 1 showing the plenum section of the second embodiment.

Referring now to FIG. 4, an extruder plenum section 18 forms the exit of the extruder section 14. The platen 80 is hingedly affixed, at its top edge, to the edge of the extruder top plate 24, at the exit of the extruder section 14, to allow rotation of the platen 80 about the hinge 82 into the plenum section 18. When open, the platen 80 extends horizontally from the hinge 82 towards the exit of the plenum section 18. When closed the platen 80 angles down at an approximately 45 degree angle from horizontal. In operation, the platen 80 is biased with a variable tension designed to control pressure in the extruder section.

The platen 80 is controlled by two or more platen cylinders 110, each of which is rotatably attached at its lower ends to the face of the platen 80 by means of a cylinder clevis 114 adapted to receive a mating mounting tab 116 protruding from the face of the platen 80 and having a clevis pin 118 penetrating the cylinder clevis 114 and mounting tab 116. The upper ends of the platen cylinders 110 are supported and sheltered by the cylinder hood 92.

The cylinder hood 92 comprises two cylinder hood side panels 104 extending vertically above the plenum section 18, a cylinder hood front panel 94 extending vertically above the exit of the plenum section 18, and a cylinder hood top panel 96 covering the platen cylinders 110 and extending horizontally back from the top edge of cylinder hood front panel 94 to the rear of the top edges of the cylinder hood side panels 104, and extending sideways slightly beyond the cylinder hood side panels 104.

The cylinder hood top panel 96 has a series of long rectangular cylinder hood top brace plates 98 mounted facewise along the bottom surface of the cylinder hood top panel 96, extending from the front to the rear of the panel. The cylinder hood top panel 96 is attached to the cylinder hood front and side panels 94, 104 through the cylinder hood top brace plates 98. The rear edge of the cylinder hood top panel 96 is also fitted with a cylinder hood lip 100 which extends vertically down from the rear edge of the cylinder hood top panel and horizontally back.

A double walled hollow beam with a rectangular cross section attached to the top of the cylinder hood top panel 96 and extending transversely across the width of the cylinder hood 92 forms the cylinder hood beam 102. The cylinder hood beam provides additional bracing for the stresses produced by the platen cylinders 110. The upper end of each platen cylinders 110 is attached to the cylinder hood 92 by means of a cylinder clevis 114 rotatably attached to a mating mounting tab 116 protruding down from the bottom surface of the cylinder hood top panel 96 directly under the cylinder hood beam 102 and having a clevis pin 118 penetrating both the cylinder clevis 114 and the mounting tab 116.

The platen cylinders 110 bias the platen 80 which provides a backpressure on the dewater material. An accumulator (not shown) fitted on the hydraulic line serving the platen cylinders 110 provides pressure to the platen cylinders 110 while allowing movement of the platen 80. Dewater material moving through the device increases pressure on the platen 80 causing the platen cylinders 110 to retract. As one skilled in the art of hydraulics will appreciate, the accumulator, with a blanket of inert gas such as nitrogen, receives excess hydraulic fluid from the platen cylinders 110 while maintaining a pressure in the platen cylinders 110.

The extruder side plates 26 and extruder bottom plate 28 extend past the end of the extruder section 14 to form the extruder plenum section 18. Two rectangular plates form the plenum braces 84 and are attached edgewise to the extruder side plates 26 where they extend to form the extruder plenum section 18. The exit of the extruder plenum section 18 is fitted with an exit flange 86 comprising an exit flange face 88, a rectangular plate having a concentric rectangular hole, and an exit flange lip 89 extending slightly outward perpendicular to the exit flange face 88. The exit flange 86 is attached to the ends of the outer face of the extruder side plates 26. The hole in the exit flange 86 extend above and below the exit of the extruder plenum section 18. An exit flange ramp 90 extends along the lower edge of the extruder plenum section 18 exit and angles down to the outside edge of the exit flange lip 89.

Figure 5:
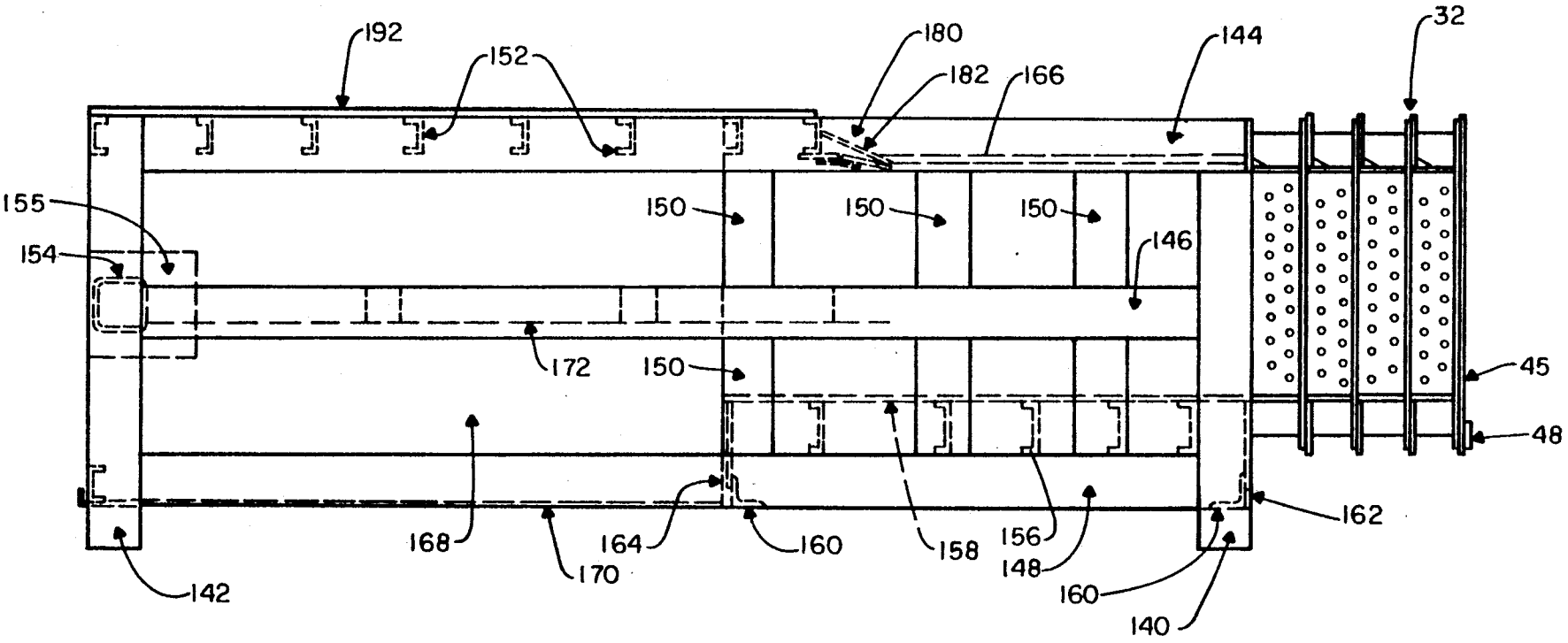
FIG. 5 is a partial side elevation of the dewatering device of FIG. 1 showing the compactor section.
Figure 6:
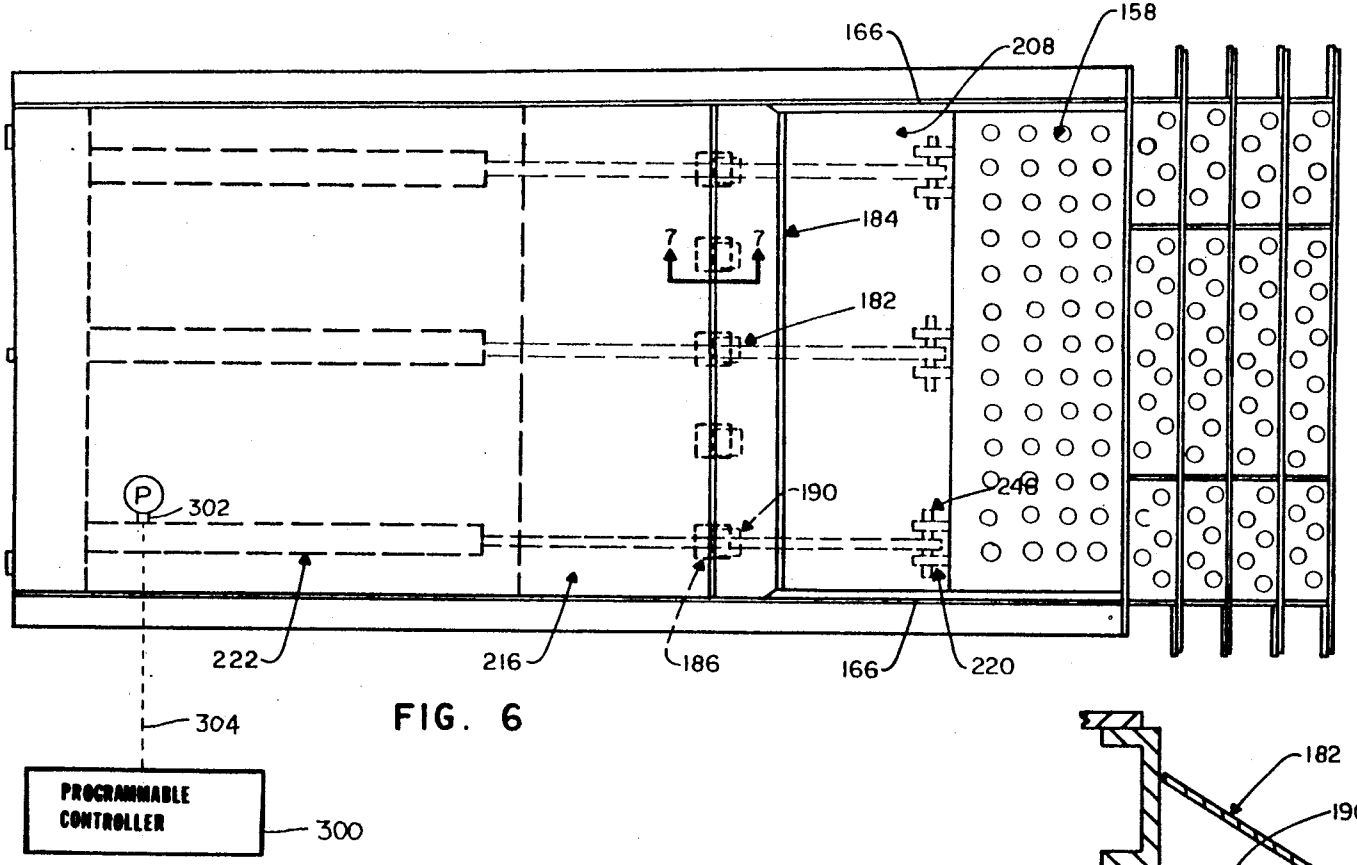
FIG. 6 is a top plan view of the compactor section of FIG. 5.

Referring now to FIGS. 5 and 6, the compactor ram assembly 10 comprises a housing 11 framed by two vertical front corner posts 140 and two vertical rear corner posts 142 connected on each side by a top horizontal side member 144 attached perpendicular to and atop the front corner post 140 and perpendicular to and abutting the rear corner post 142, a middle horizontal side member 146 attached slightly above the midline of the front corner 140 and rear corner post 142, and a bottom horizontal side member 148 attached between and slightly above the bottom of the front corner post 140 and rear corner post 142. Additional bracing is provided by three vertical side members 150 attached between the top horizontal side member 144 and the middle horizontal side member 146 on each side. Two of the vertical side members 150 are provided beneath the hopper 16 and an additional vertical side member 150 is immediately behind the hopper 16. Three additional vertical side members are placed between the middle horizontal side member and the bottom horizontal side member on each side immediately below the aforementioned vertical side members 150. The compactor ram assembly 10 is enclosed by two side panels 168 attached just inside of the front and rear corner post 140, 142, a top panel 192 attached to the top horizontal side members 144 and extending back from the hopper 16 to the rear corner post 142 and a rear floor plate 170 extending along the bottom of the bottom horizontal side member to the first vertical side member 150.

The housing 11 thus defines a cavity in the interior thereof which is open at one end for communication with the snout section 12. The cavity is also open at the top for receiving dewater material from the hopper 16. A loading floor 158 is provided within the cavity below the hopper 16 for receiving the wet matter to be dewatered. The loading floor 158 is supported by a series of lower cross members 156 mounted horizontally and transversely to the direction of ram travel. The lower cross members 156 are mounted between the side panels 168 and immediately above the bottom horizontal side members 148. Additionally, the loading floor 158 is supported by a front plate 162 and rear plate 164 mounted vertically at the front end rear edge of the loading floor 158 and installed between the side panels 168. The bottom of the front and rear plates 162, 164 are supported by angle brackets 160 mounted between the side panels 168. The loading floor 158 is connected to, and is at the same elevation as the extruder bottom plate 22. To assist in dewatering, the loading floor 158 is penetrated by a matrix of drainage holes 25.

A series of upper cross members 152 also support the housing 11 laterally. The upper cross members 152 are mounted horizontally and attached at each end to the side panels 168 immediately below the top panel 192. Both the upper and lower cross members 152, 156 are C-shaped in cross section.

Figure 8:
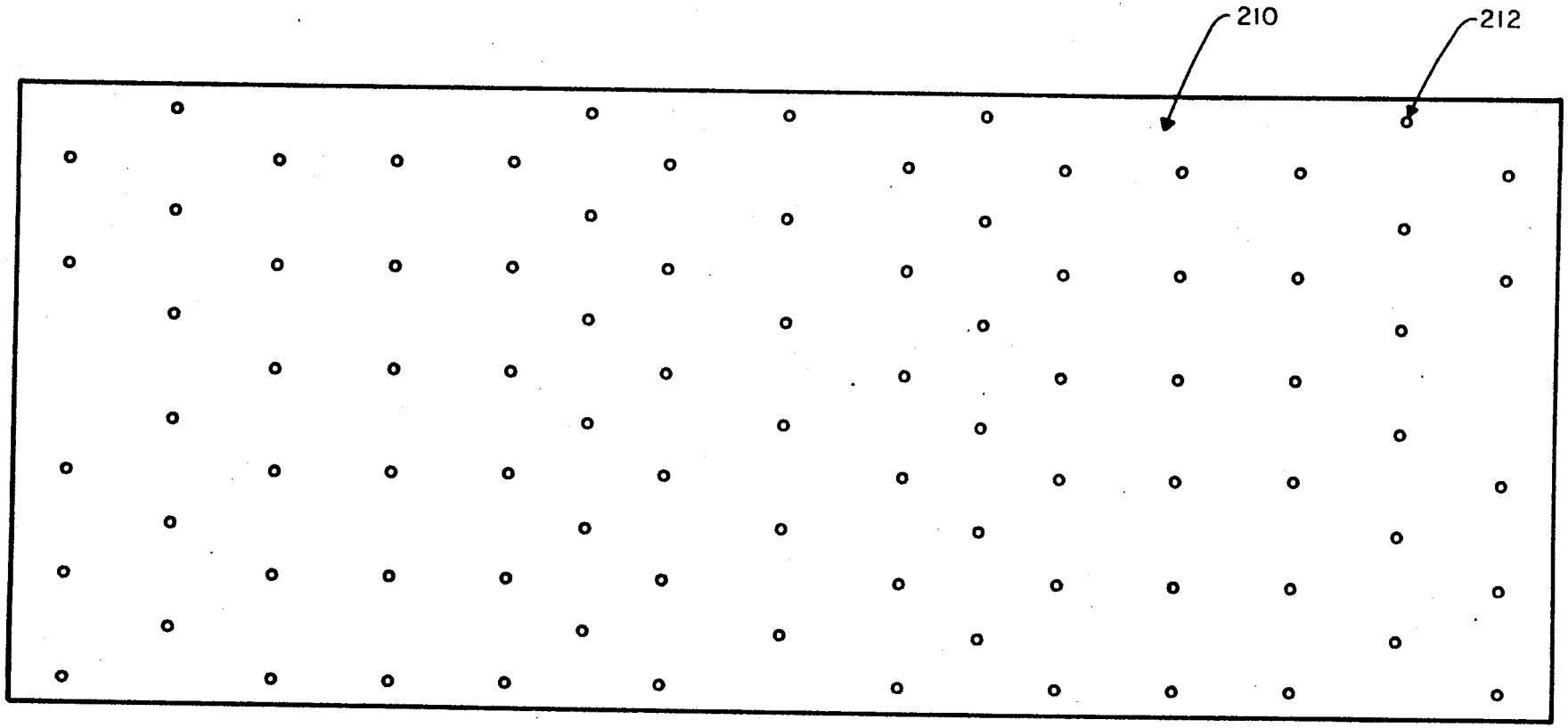
FIG. 8 is a front elevation of the ram face.
Figure 9:
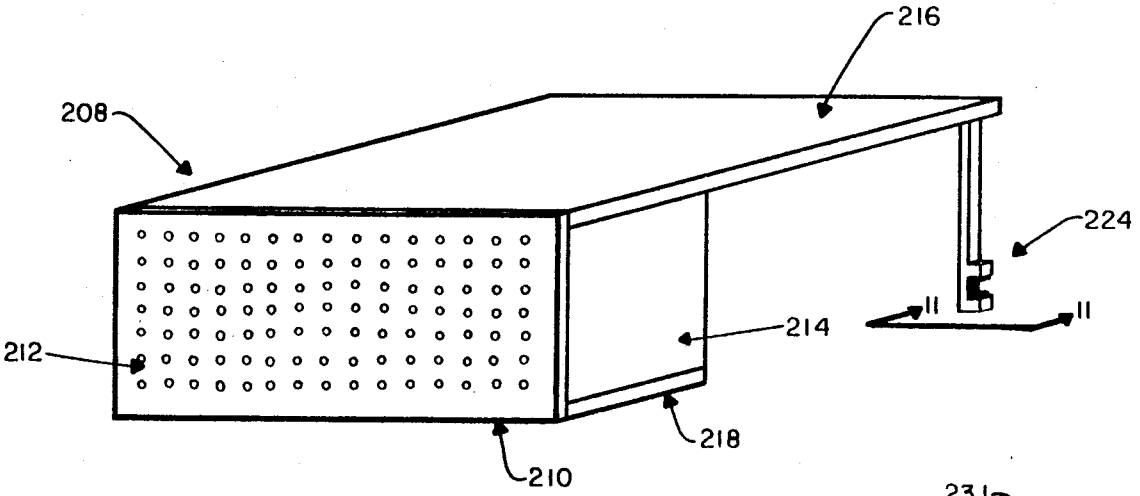
FIG. 9 is a perspective view of the ram.
Figure 10:
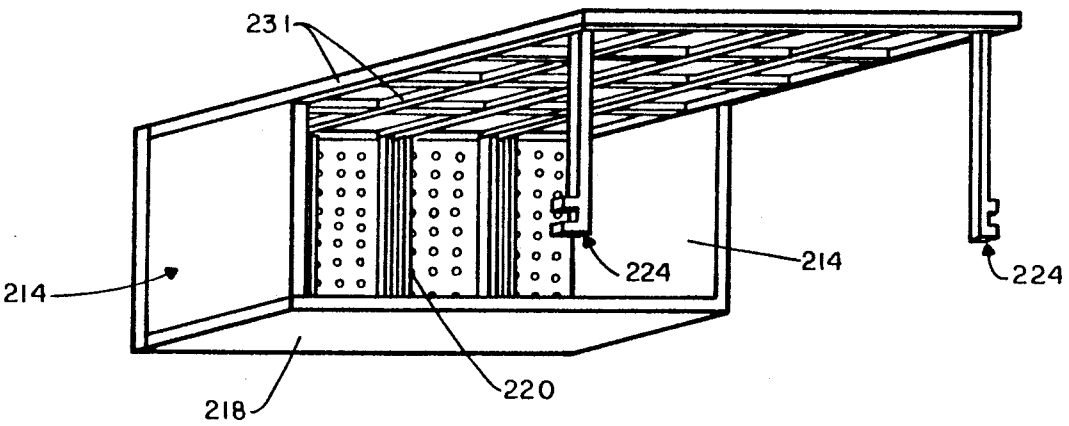
FIG. 10 is a perspective view of the ram from the underside and rear.

Referring as well to FIGS. 8, 9 and 10, the ram 208 comprises a ram face 210 having a matrix of holes 212 to allow water to escape during the dewatering process. FIG. 8 shows the arrangement and spacing of the holes on the ram face 208. The holes 212 are preferably ¼ inch in diameter with a range of ⅛ to ⅜ inches depending upon the material being dewatered. The exact arrangement of the holes 212 depends upon the support structure used to brace the ram face 208 and attach the ram cylinders 222, but the holes 212 are generally arranged in horizontal rows, all two inches apart, and vertical columns three to four inches apart.

The ram face is braced by the ram side plates 214, the ram bottom plates 218, and the ram top plates 216. The ram side plates 214 extend rearwardly from the rear of the ram face 210 and are attached edgewise at the outside edge of the rear of the ram face 210. The ram bottom plate 218 is attached in a similar manner on the bottom rear edge of the ram face 210. The ram bottom plate 218 is thus adapted to move reciprocally with the ram on the loading floor 158. The ram top plate 216 is attached similarly to the top rear edge of the ram face 210 and extends much further back than the ram side plates 214 and the ram bottom plates 218, so that it may protect the ram cylinders 222 during operation, and to prevent dewater material from falling behind the ram face 210.

The ram top 216 is braced by 5 or 6 longitudinal braces 238 comprising six inch channel beams welded along the bottom surface of the ram top 216 extending from the front to the rear of the ram top 216. Additional bracing of the ram top 216 is provided by lateral braces 236 of six inch channel beam stock welded to the bottom surface of the ram top 216 perpendicular to the longitudinal braces 238 and placed in between the longitudinal braces 238 in a grid formation, with more emphasis on the front portion of the ram top 216, near the ram face 210.

The ram face 210 is driven by three ram cylinders 222 mounted at one end to the rear of the ram face 210 and at the other end to the rear cross member 154. The ram cylinders are mounted to the ram face 210 by means of three pairs of splines 220 mounted edgewise to the rear of the ram face 210 and extending from the top to the bottom of the ram face 210. The splines 220 are also attached at their ends to the ram top 216 and the ram bottom 218. The splines provide bracing and are spaced so that a tab 242 on the end of each ram cylinder 222 will fit in between a pair of splines 220. Holes 244 penetrating the face of each spline 220 at the midsection mate with a hole in each tab 242 receiving a pin 246 to affix the ram cylinder 222 to the ram face 210.

The rear cross member 154 comprises a hollow beam, having a rectangular cross section, horizontally mounted at each end to the inside rear face of the side panels 168, perpendicular to the side panel 168 and parallel and flush to the rear wall of the ram compactor assembly 10. The rear cross member 154 bears the load of the ram cylinders 222 and rear cross member mounting plates 155 are provided at the mounting points of the rear cross member 154 for increased strength. The ram cylinders 222 are bolted to the rear cross member 154.

A pair of access doors 157 is provided at the rear wall of the ram compactor assembly 10.

Figure 11:
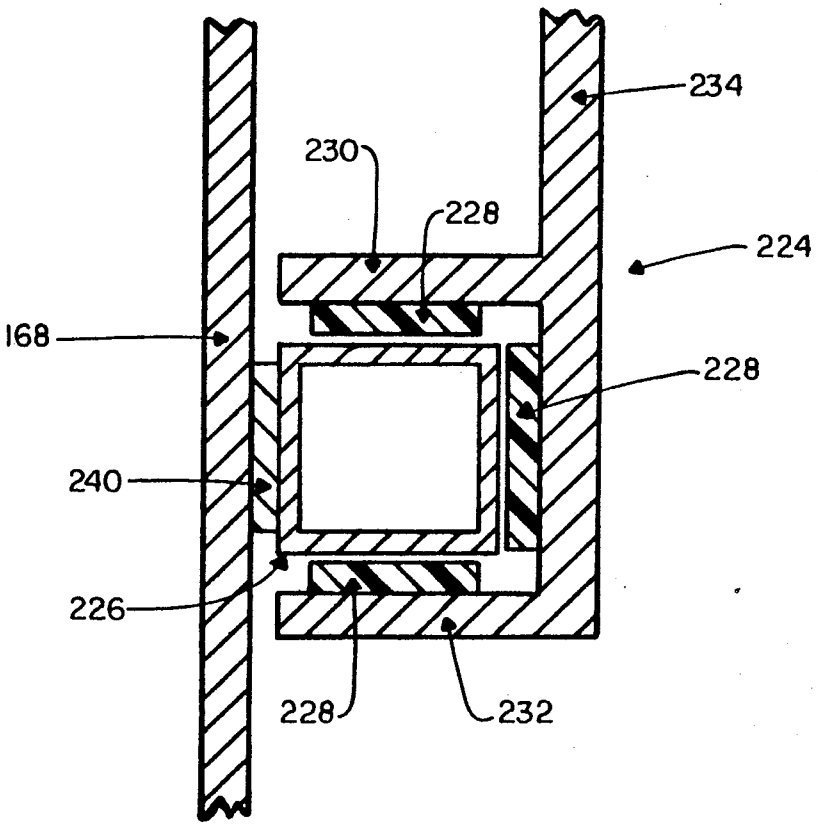
FIG. 11 is a cross section taken along line 11—11 of FIG. 9, showing the ram guide.

Referring now to FIG. 11, direction of ram travel is controlled by a pair of ram guides 226. Each ram guide 226 comprises a hollow beam of rectangular cross section mounted horizontally at about the midsection of, and along the inside wall of the side plate 168 by means of several ram guide spacers 240 mounted along the ram guide 226 which are in turn mounted to the side wall 168, thus holding the ram guide 226 slightly away from the side wall 168. A C-shaped ram guide bracket 224 shaped to receive the ram guide 226 travels along each ram guide 226 in operation and keeps the ram 208 oriented properly.

A pair of vertical arms 234 extends vertically down from the rear corners of the ram top 216, being mounted to both the inside of the outermost longitudinal brace 236, the inside of the most rear lateral brace 236 and to the underside of the ram top 216. At the bottom of each vertical arm 234 a lower arm 232 and an upper arm 230 extend horizontally towards the side panel 168 forming the structure of the ram guide bracket 224. The surfaces of the lower arm 232, the upper arm 230 and the vertical arm 234 oriented toward the ram guide 226, are provided with NYLATRON TM (or a suitable substitute) ram guide inserts 228, mounted by means of countersunk screws, which contact the ram guide 226 during operation. The ram guide inserts 228 reduce friction and are easily replaceable when worn.

The ram guide 226 orients and guides the ram 208 from the rear due to the placement of the vertical arms 234. The ram face is guided by the loading floor 158 on the bottom, the side panels 168 on the sides, and a pair of side beads 166 along the top. The side beads are mounted to the side panels 168 extending horizontally along the upper edge of the ram face 210 travel to prevent the ram 208 from becoming misaligned in the upwards direction.

Figure 7:
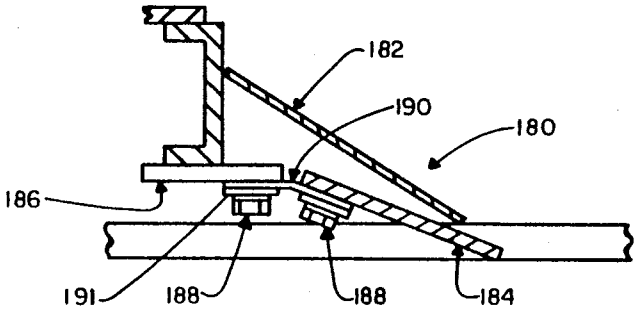
FIG. 7 is a cross-sectional view taken along the line 7—7 of FIG. 6 showing the scraper assembly in detail.

Referring now to FIG. 7, the top surface of the ram top plate 216 is cleaned by a scraper assembly 180 which scrapes the excess pulp to be dewatered off the ram 208 and onto the loading floor 158 as the ram is retracted. The scraper assembly 180 comprises a scraper plate 184 attached to the bottom of the foremost upper cross member 152 by means of a series of fabric scraper hinges 190 and mounting plates 186. Each mounting plate 186 is mounted in a horizontal orientation to the bottom of the foremost upper cross member 152. The fabric scraper hinges 190 are mounted to the underside of the mounting plates 186 and scraper plate 184 by means of a scraper hinge screw 188 and scraper hinge washer 191. The scraper assembly 180 extends transversely across the entire width of the hopper opening 16, and the front edge of the scraper plate 184 contacts the top surface of the ram top plate 216. The angle plate 182 is mounted immediately above the scraper plate 184, extending transversely across the entire width of the ram top plate 216. The upper rear edge of the angle plate 182 is mounted to the forward face of the foremost upper cross member 152; the angle plate 182 angles down until the front edge is slightly above the top surface of the scraper plate 184. The orientation of the fixedly mounted angle plate 182 provides a limited amount of movement for the scraper plate 184 about the scraper hinges 190.

Figure 17:
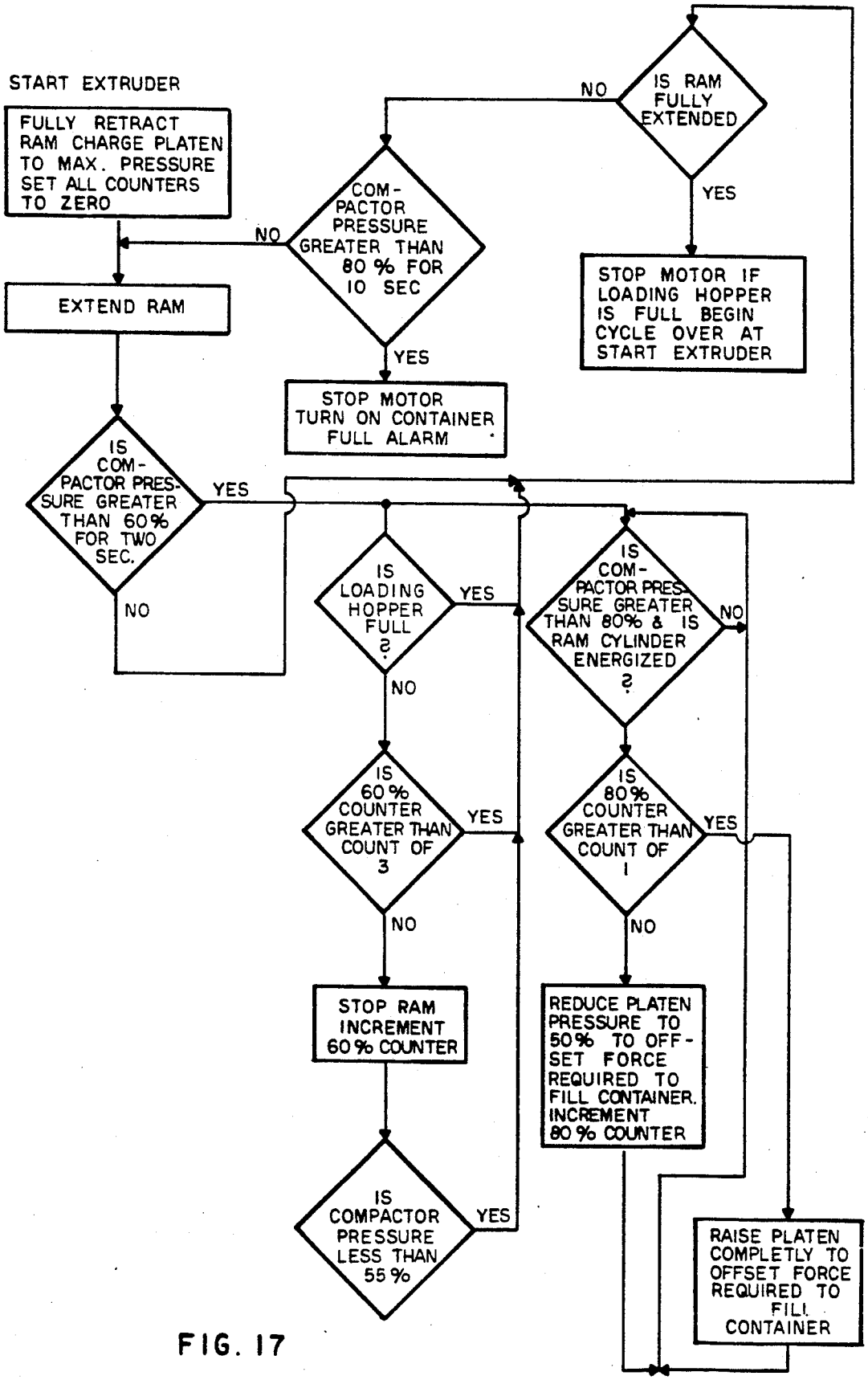
FIG. 17 is an operational flow chart showing the logic steps in the controller.

Referring to FIGS. 17, the dewatering process is controlled by a programmable logic controller 300, which reads the pressure applied by the hydraulic cylinder 222 by a pressure sensing means well known to those skilled in the art. For example, a conventional pressure sensor 302 may be linked to the programmable controller 300 by means of a communication line 304 (see FIG. 6). There are two major counters in the controller: a 60% pressure counter, and an 80% pressure counter.

The cycle starts by resetting all counters to zero, retracting the ram 208 to its fully retracted position and pressurizing the platen cylinders 110. At this step, the ram cylinders 222 are charged which extends the ram 208 until the pressure in the ram cylinder 222 reaches 60% of a predetermined maximum for two seconds, which increments the 60% counter.

At this point, the ram cylinders 222 stop ram 208 travel and hold ram 208 stationary. As liquid escapes from the dewater material, the volume inside the device decreases, decreasing the pressure on ram 208. When the pressure in the ram cylinders falls below 55% of the predetermined maximum, the controller charges the ram cylinders 222 and extends the ram 208 until the pressure in the ram cylinders 222 again reaches 60% of the predetermined maximum, for two seconds. Each time the 60% pressure is reached for two seconds or more, the 60% counter is incremented. The controller continues to stop and start ram 208 travel in this manner until the 60% counter exceeds reaches three. After the three cycles, the controller fully extends the ram 208.

To prevent hopper overflow, the cycle may be speeded up. After the 60% counter reaches 1, if the hopper full sensor (not shown) indicates that the hopper 16 is reaching capacity, the ram 208 will not be stopped at 60% pressure.

During ram 208 travel, the controller monitors the pressure in the ram cylinders 222. If that pressure reaches 80% of the predetermined maximum, it increments the 80% counter to count 1. At count 1, the platen cylinder 110 pressure is reduced to 50% of a predetermined maximum pressure. If ram cylinder 222 pressure again reaches 80%, the 80% counter is incremented to count 2 and the platen 80 is raised fully for the remainder of that cycle.

An object of the platen 80 is to provide a back pressure in the device to improve dewater efficiency and to control flow of dewatered material out of the device. For maximum efficiency, it is desirable to keep ram cylinder 222 pressures in the range of 60% to 80% of predetermined maximum.

It is also desirable to fill the dewater-receiving container as full as possible. To that purpose, if ram cylinder 222 pressure reaches 80% of maximum, the controller first decreases platen cylinder 110 pressure to 50% of its predetermined maximum and on the second occurrence, the platen 80 is retracted to its full-up position for the remainder of that cycle.

The "platen 80 full up" and "50% pressure" operations help offset forces required to effect dewatered material to the far end of the dewater-receiving container. If pressure in the ram cylinders 222 remains at 80% for longer than ten seconds, the hydraulic power unit will shut off and an alarm alerts the operator that the container receiving the dewatered product exiting the device is full and needs to be emptied.

Figure 14:
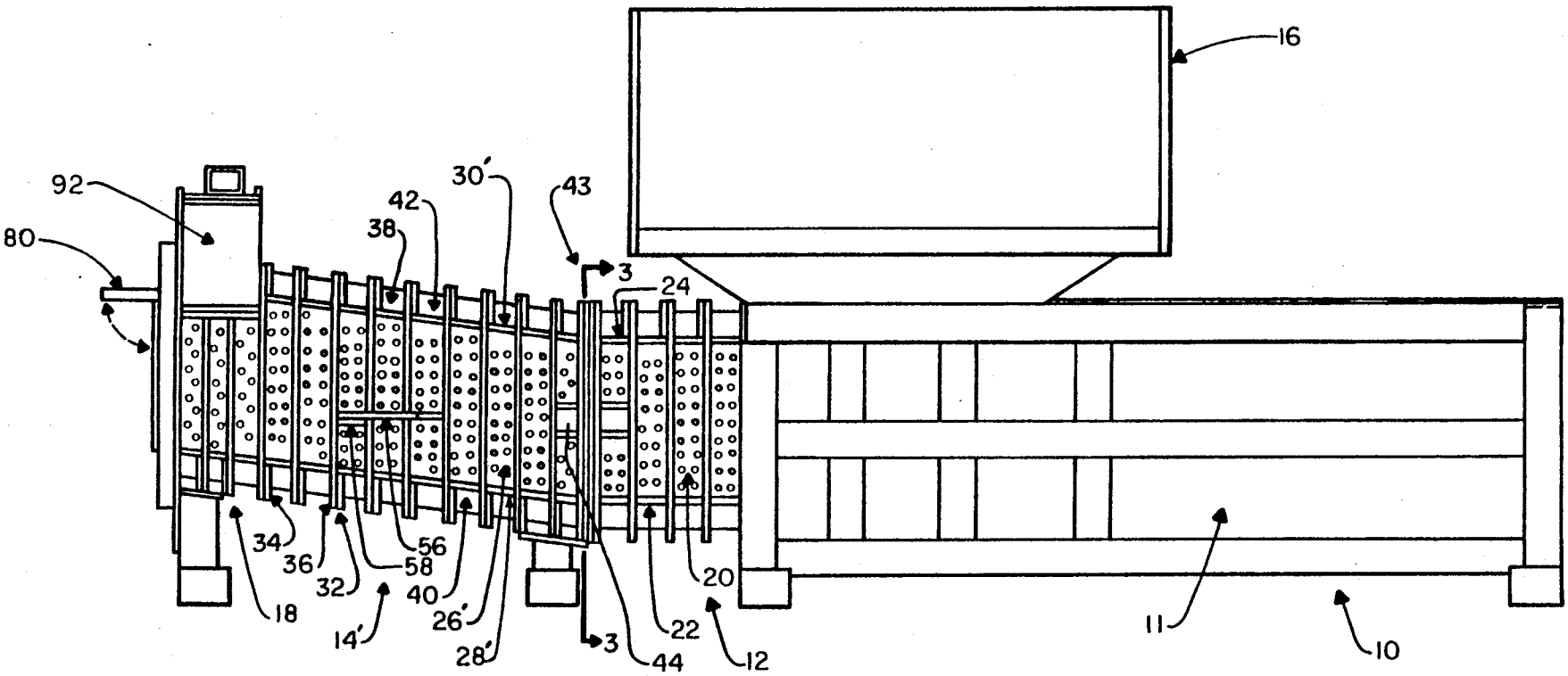
FIG. 14 is a left side elevation of a second embodiment of the extruder section according to the invention.
Figure 15:
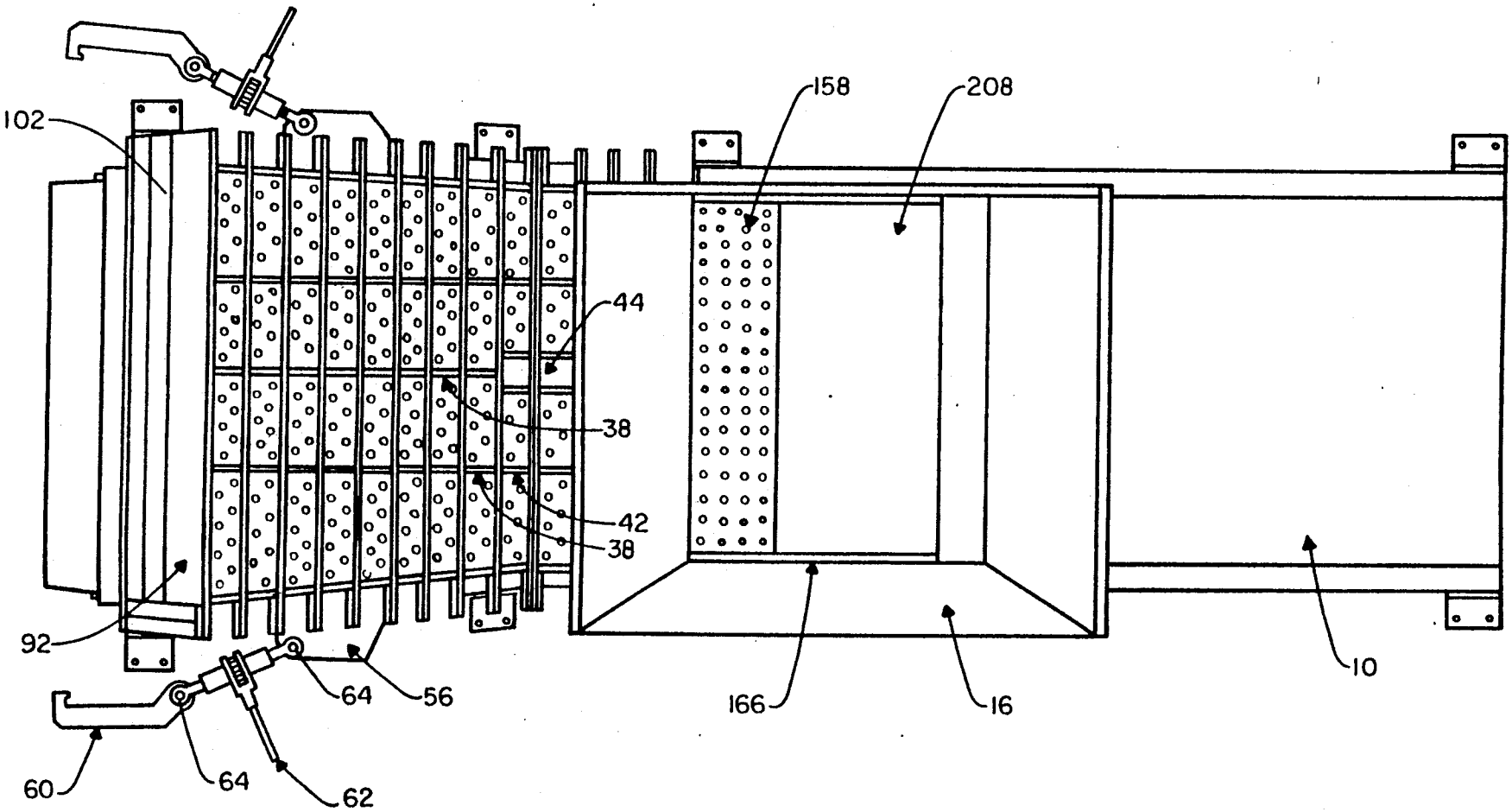
FIG. 15 is a top plan view of the extruder section of the second embodiment.

Referring now to FIGS. 14 and 15, it can be seen that a second, preferred embodiment of the invention employs a diverging extruder section 14'. While the converging extruder section 14 of the first embodiment promotes maximum liquid extraction, some materials, such as paper pulp, may become impacted due to a higher degree of incompressibility or higher coefficient of friction. The second embodiment is the preferred embodiment for most dewater material mixtures; the first embodiment performs well with oils or other mixtures with a lower coefficient of friction in the dewater product.

In all respects the second embodiment is equivalent to the first embodiment except for the slightly diverging nature of the extruder section 14'. The extruder bottom plate 28' is oriented with the same upward tilt as in the first embodiment, with the edge connecting to the extruder plenum 18' higher than the edge connected to the snout section 12. The extruder top plate 30' is oriented parallel to the extruder bottom plate 28'. The extruder side plates 26' are oriented to provide a diverging flow for the dewater material through the device, as shown in FIG. 15, with the edges of the extruder side plates 26' connected to the snout section 12 slightly closer together than the edges of the extruder side plates 26' connected to the extruder plenum 18.

Figure 16:
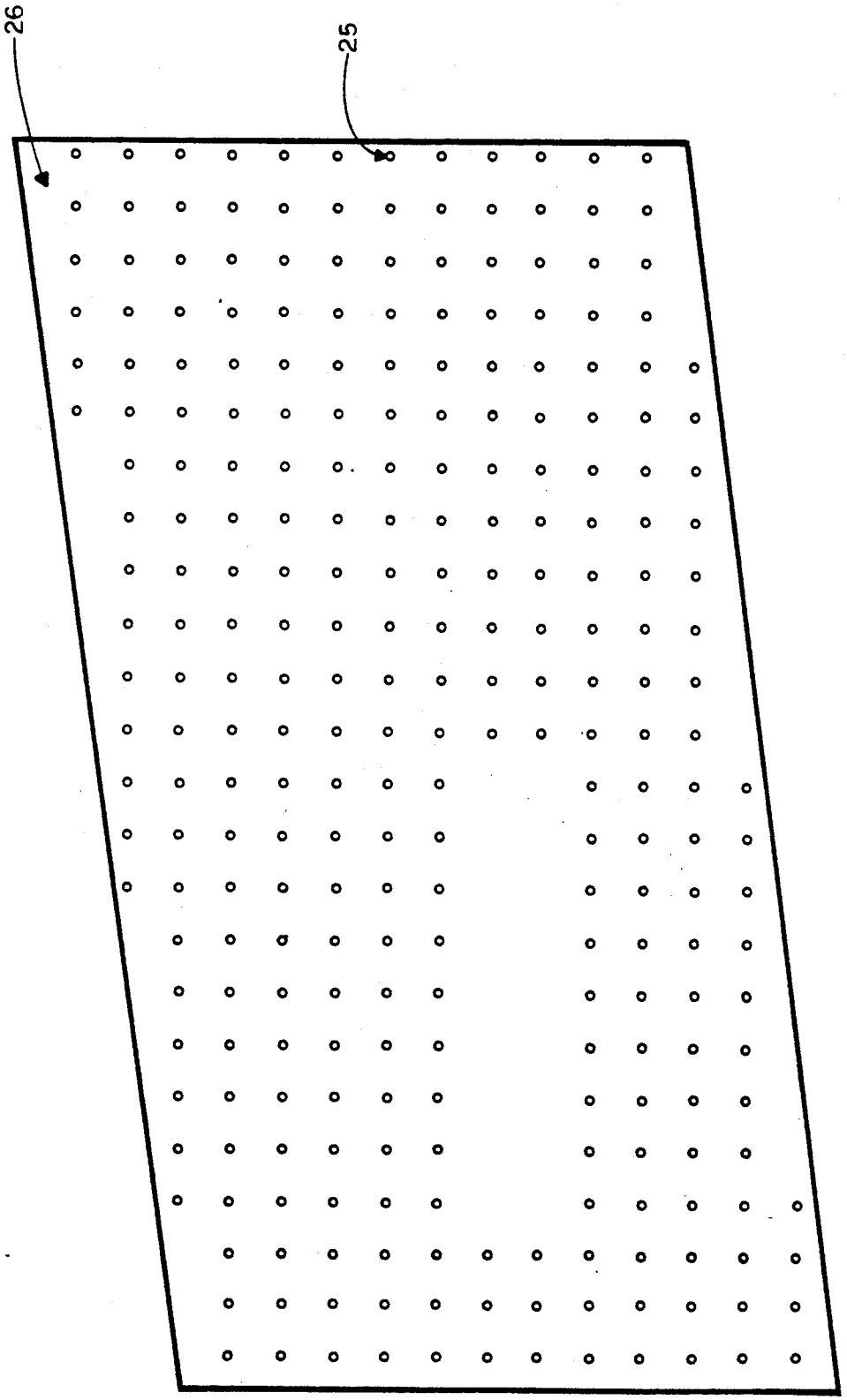
FIG. 16 is a detail view of the extruder side plates for the second embodiment showing the drainage hole arrangement.

The drainage holes 25 in the extruder top and bottom plates 30', 28' are arranged in the same fashion as the drainage holes 25 in the extruder top and bottom plates 30, 28 of the first embodiment. As shown in FIG. 16, the drainage holes 25 in the extruder side plate 26' are arranged in a grid with horizontal and vertical rows each spaced two inches apart. In all other respects, the second embodiment is similar to the first embodiment.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure of the invention without departing from the scope of the invention.

The embodiments of the invention in which an exclusive property or privilege is claimed are defined as follows:

1. An apparatus for extracting liquid from a composite mass of liquid and solids, said apparatus comprising:

a housing having a cavity open at one end with an axis extending therethrough;

a first platen mounted wi thin the housing for movement from a retracted position adjacent to the cavity, through the cavity and along the axis to an extended position near the open end, said platen having a matrix of apertures therethrough;

an hydraulic cylinder operably connected to the first platen to cause movement thereof;

an extruder connected to the housing at the open end and having opposed top and bottom walls and opposed side walls, said top, bottom and side walls defining a channel in communication with the cavity extending to an exit opening, said bottom wall being inclined upwardly at an angle from the axis, each of said walls having a matrix of apertures therethrough;

a second platen mounted to one of said extruder walls near the exit opening for pivotable movement inwardly of the channel, said second platen being configured to restrict the cross-sectional area of the channel; and biasing means connected to the second platen for maintaining the second platen inwardly of the channel against a predetermined pressure;

the composite mass being compressible within the cavity and the channel and between the first and second platens whereby to extract liquid therefrom and force it through the apertures and further whereby to move the remaining mass through the exit opening when the pressure of the composite mass exceeds the predetermined pressure; and wherein the path of the liquid, after extraction through the apertures, is sufficiently unobstructed to prevent backpressure on the matrices resulting from an accumulation of liquid and solids outside the housing and extruder.

2. An apparatus according to claim 1 wherein at least one of the extruder walls diverges away from its opposing wall so that the cross-sectional area of the channel near the housing is less than the cross-sectional area of the channel away from the housing.

3. An apparatus according to claim 2 wherein the side walls diverge away from the axis.

4. An apparatus according to claim 2 wherein the side walls diverge away from the axis one inch in ten feet.

5. An apparatus according to claim 4 wherein a loading platform is mounted within the housing at a lower portion of the cavity to support the composite mass.

6. An apparatus according to claim 5 wherein the loading platform has a matrix of apertures therethrough.

7. An apparatus according to claim 1 wherein at least one of the extruder walls converges toward its opposing wall so that the cross-sectional area of the channel near the housing is greater than the cross-sectional area of the channel away from the housing.

8. An apparatus according to claim 7 wherein the top and bottom walls converge and the side walls converge.

9. An apparatus according to claim 8 wherein the cross-sectional area of the channel at the connection to the housing is 1500 square inches and the cross-sectional area of the channel at the connection of the second platen is 1025 square inches.

10. An apparatus according to claim 7 wherein the channel has a first end and a second end opposite the first end, the first end being in communication with the open end of the housing, and the cross sectional area of the channel at the first end is approximately 1½ times the cross sectional area of the channel at the second end.

11. An apparatus according to claim 1 wherein the cavity is open through the top of the housing for receiving the composite mass.

12. An apparatus according to claim 1 wherein the predetermined pressure is 1500 psi.

13. An apparatus according to claim 1 wherein the diameter of the apertures is in a range of ⅛ to ⅜ inches.

14. An apparatus according to claim 1 wherein the matrices are formed by a multiplicity of apertures, each aperture being spaced from an adjoining aperture within a range of 1½ to 4 inches.

15. An apparatus according to claim 1 wherein the biasing means comprises a hydraulic cylinder, and wherein the pressure applied by the biasing means is controlled by a programmable controller.

16. An apparatus according to claim 15 further comprising a pressure sensing means in communication with the programmable controller for sensing a pressure internal to the composite mass, and wherein the programmable controller reduces the pressure applied by the biasing means by a predetermined amount in response to the pressure measured by the pressure sensing means exceeding a predetermined level above a normal operating pressure.

17. An apparatus according to claim 16 wherein the programmable controller eliminates the pressure applied by the biasing means in response to the pressure measured by the pressure sensing means exceeding a predetermined level above a normal operating pressure for a predetermined time, to expedite movement of the composite mass out of the extruder.

18. An apparatus for extracting liquid from a composite mass of liquid and solids, said apparatus comprising:

a housing having a cavity open at one end with an axis extending therethrough;

a platen mounted within the housing for movement from a retracted position adjacent to the cavity, through the cavity and along the axis to an extended position near the open end, said platen having a matrix of apertures therethrough;

an hydraulic cylinder operably connected to the platen to cause movement thereof;

an extruder connected to the housing at the open end and having opposed top and bottom walls and opposed side walls, said top, bottom and side walls defining a channel having a first end and an opposite second end, the first end of the channel being in communication with the cavity and the second end defining an exit opening, said bottom wall being inclined upwardly at an angle from the axis, at least one of the extruder walls converging toward its opposing wall so that the cross-sectional area of the channel at the first end is approximately 1½ times the cross sectional area of the channel at the second end, and each of said walls having a matrix of apertures therethrough;

the composite mass being compressible within the cavity and the channel and between the platen and the converging walls of the extruder whereby to extract liquid therefrom and force it through the apertures and further whereby to move the remaining mass through the exit opening.

19. An apparatus according to claim 18 wherein the top and bottom walls converge and the side walls converge.

20. An apparatus according to claim 19 wherein the cross-sectional area of the channel at the connection to the housing is 1500 square inches and the cross-sectional area of the channel at the connection of the second platen is 1025 square inches.

21. An apparatus according to claim 18 wherein the cavity is open through the top of the housing for receiving the composite mass.

22. An apparatus according to claim 18 wherein a loading platform is mounted within the housing at a lower portion of the cavity to support the composite mass.

23. An apparatus according to claim 22 wherein the loading platform has a matrix of apertures therethrough.

24. An apparatus according to claim 18 wherein the diameter of the apertures is in a range of ⅛ to ⅜ inches.

25. An apparatus according to claim 18 wherein the matrices are formed by a multiplicity of apertures, each aperture being spaced from an adjoining aperture within a range of 1½ to 4 inches.

* * * * *